US005462573A

United States Patent [19]

Baker et al.

[11] Patent Number: 5,462,573

[45] Date of Patent: Oct. 31, 1995

[54] VALVE SEAT INSERTS OF SINTERED FERROUS MATERIALS

[75] Inventors: Andrew R. Baker, Lighthorn; Richard L. Kettle, Hinckley, both of England

[73] Assignee: Brico Engineering Limited, Coventry, England

[21] Appl. No.: 188,631

[22] Filed: Jan. 21, 1994

Related U.S. Application Data

[63] Continuation of Ser. No. 854,783, Mar. 23, 1992, abandoned, which is a continuation of Ser. No. 567,107, Aug. 14, 1990, abandoned, which is a division of Ser. No. 254,169, Oct. 6, 1988, Pat. No. 4,970,049.

[30] Foreign Application Priority Data

Oct. 10, 1987 [GB] United Kingdom ..... 8723818

[51] Int. Cl.[6] ..... C22C 38/24

[52] U.S. Cl. ..... 75/231; 75/236; 75/239; 75/240; 75/241; 75/246

[58] Field of Search ..... 75/231, 236, 239, 75/240, 241, 246

[56] References Cited

U.S. PATENT DOCUMENTS

| | | | |
|---|---|---|---|
| 3,653,982 | 4/1972 | Prill | 75/246 |
| 3,982,907 | 9/1976 | Honma | 75/236 |
| 4,485,770 | 12/1984 | Saka et al. | 123/90.39 |
| 4,648,903 | 3/1987 | Ikenoue et al. | 75/236 |
| 4,755,222 | 7/1988 | Heinze et al. | 75/246 |

*Primary Examiner*—Donald P. Walsh
*Assistant Examiner*—Daniel Jenkins
*Attorney, Agent, or Firm*—William R. Hinds

[57] ABSTRACT

Sintered ferrous materials are described having a composition in wt % lying within the ranges of C 0.8–1.5/W 1–4.4/Mo 1–4.4/V 1–2.6/Cr 1.3–3.2/Others 3 max./Fe balance. The material may be made by a method comprising the steps of mixing between 40 and 70 wt % of a powder having a composition in wt % within the ranges C 0.45–1.05/W 2.7–6. 2/Mo 2.8–6.2/V 2.8–3.2/Cr 3.8–4.5/Others 3.0 max./Fe balance with between 60 and 30 wt % of an iron powder and from 0.4 to 0.9 wt % of carbon powder, pressing a green body of the article from the mixed powder and then sintering the green body. The material may optionally contain sulphur, metallic sulphides. The material may be infiltrated.

6 Claims, No Drawings

VALVE SEAT INSERTS OF SINTERED FERROUS MATERIALS

This is a continuation of application Ser. No. 07/854,783 filed Mar. 23, 1992, now abandoned, which is a continuation of Ser. No. 07/567,107 filed Aug. 14, 1990, now abandoned, which is a division of Ser. No. 254,169 filed Oct. 6, 1988, now U.S. Pat. No. 4,970,049 issued Nov. 13, 1990.

The present invention relates to valve seat inserts of sintered ferrous materials.

It is known to use sintered and infiltrated tool steel type alloys for the production of valve seat inserts for internal combustion engines. One such known material has the composition in weight % C 0.6–1.5/W 4–6/Mo 4–6/V 2–3/Cr 2.5–4/Cu 15–25/others 2 max/Fe balance. Such alloys are costly because of the high level of alloying additions and also abrasive to the co-operating valve seating face which may require to be coated with an alloy such as stellite, for example.

Generally components are pressed from a pre-alloyed powder and then either sintered and infiltrated with a copper-based alloy simultaneously or sintered and infiltrated as two separate operations. Because of the highly alloyed nature of the powder the compressibility is relatively low due to the high work hardening rate.

Therefore, high pressing pressures are needed if relatively high green densities are required. Higher pressing pressures result in added cost of dies and pressing equipment and also greater wear rates on such equipment.

It has generally been thought heretofore that relatively high levels of alloying additions were necessary for the manufacture of such articles as valve seat inserts for high performance internal combustion engines. It has now been realised, however, that highly alloyed materials have lower thermal conductivities than less highly alloyed materials. The effect of this is that the running temperature of the insert in the cylinder head is relatively high. By providing a lower level of alloying addition two major advantages are achieved. Firstly, the thermal conductivity of the material at a given density is increased. Secondly, the lower level of alloying additions allows greater densities to be achieved at a given pressing pressure. A consequential effect of the second advantage is that the greater density also confers improved thermal conductivity and which may obviate the need for infiltration.

The improved thermal conductivity of lower alloyed material under a given set of conditions provides a lower working temperature of the insert in the cylinder head. The reduction in working temperature allows the use of a lower hot strength material.

The extent to which thermal conductivity and hot strength may be traded off against each other will of course depend upon the operation conditions of each particular engine.

GB 2188 062 describes the use of sintered alloys made from mixtures of high-speed steels and unalloyed or low-alloy iron powder for wearing parts in machines and vehicles. A disadvantage of the materials described is that they are lacking in hot-wear resistance in applications such as valve seat inserts.

An additional advantage of lower alloyed materials is that they are less abrasive and may permit the use of plain valve materials without the need for coating of the valve facing.

We have now found that advantageous properties may be obtained, particularly in hot-wear resistance, in alloys according to the present invention.

According to a first aspect of the present invention a sintered ferrous material comprises a composition expressed in wt % within the ranges C 0.8–1.5/W 1–4.4/Mo 1–4.4/V 1–2.6/Cr 1.3–3.2/Others 3 max./Fe balance. A more preferred carbon content is in the range 0.8 to 1.1 wt %.

Preferably the material comprises a tempered martensitic matrix containing spheroidal alloy carbides. Bainite and a small proportion of ferrite may also be present.

According to a second aspect of the present invention a method of making a sintered ferrous article comprises the steps of mixing between 40 and 70 wt % of an alloyed powder having a composition in wt % within the ranges C 0.45–1.05/W 2.7–6.2/Mo 2.8–6.2/V 2.8–3.2/Cr 3.8–4.5/ Others 3.0 max./Fe balance with between 60 and 30 wt % of an iron powder and from 0.4 to 0.9 wt % of carbon powder, pressing a green body of the article from the mixed powder and then sintering the green body.

We have found that if a minimum of 2.8 wt % vanadium is used in conjunction with a minimum of 0.8 wt % carbon, acceptable hot-wear resistance may be produced in the resulting sintered materials.

The material may optionally contain from 4 to 6 wt % of copper added in the form of powder to the mixture as a sintering aid.

The material may optionally contain up to 1.0% sulphur as an aid to machinability. Sulphur may, for example, be added as elemental sulphur or pre-alloyed into the ferrous base powder.

The material may further comprise additions of up to 5% of metallic sulphides which may include, for example, molybdenum disulphide or manganese sulphide. Such additions may be made for their beneficial effect on wear-resistance, solid lubrication and machinability. Additions may be made at the powder blending stage but, however, the resulting sintered material will comprise a complex sulphide structure owing to diffusion effects between constituents during sintering.

Due to the steps of mixing the alloy steel powder with iron powder and of adding carbon as graphite, powder mixes of the present invention may possess compressibility superior to known prealloyed powders and thus may be compacted to higher initial densities. It is intended that the alloys of the present invention may be compacted to green densities in excess of 80% of theoretical density and preferably in excess of 85%.

Materials of the present invention may optionally be infiltrated with a copper based alloy. Such infiltration may be successfully accomplished at compacted densities of substantially greater than 85% of theoretical although, of course, this is conditional on the presence of inter-connected porosity. Lower densities of material may, of course, be infiltrated. Where the material is infiltrated an addition of 4 to 6 wt % of copper powder to the mix may not be required.

Sintering and infiltration steps maybe carried out either consecutively or simultaneously.

The iron powder may be substantially pure iron powder containing only those impurities normally associated with and found in iron powder or may be any other low-alloyed iron powder.

Free carbon is employed in the powder mixture to ensure the formation of wear-resistant iron-based phases, for example bainite, in the iron phase after sintering.

It has been found that valve seat inserts for internal combustion engines made from the material and by the process of the present invention may be used in conjunction with valves having unfaced seatings without excessive wear occurring on the valve seating. Valves having seatings faced with Stellite (trade mark), for example, may of course be used.

The articles made by the process of the invention may optionally be thermally processed after sintering. Such thermal processing may comprise a cryogenic treatment in, for example, liquid nitrogen followed by a tempering heat treatment in the range 575° C. to 710° C., Following such heat treatment the alloy matrix comprises tempered martensite with spheroidised alloy carbides. Bainite and occasional ferritic regions may also be present. The porosity of infiltrated material is essentially filled with copper based alloy.

According to a further aspect of the invention, as claimed herein, a valve seat insert for an internal combustion engine cylinder head consists of a sintered ferrous-based material having a matrix comprising a pressed and sintered powder, the metallurgical structure of the matrix comprising tempered martensite containing spheroidal alloy carbides, bainite and ferrite, the powder having been pressed to greater than 80% of theoretical density from a mixture including two different ferrous-based powders, the mixture consisting essentially of between 40 and 70 wt % of a pre-alloyed powder having a composition in wt %, apart from impurities, within the ranges of: carbon 0.45–1.05/tungsten 2.7–6.2/molybdenum 2.8–6.2/vanadium 2.8–3.2/chromium 3.8–4.5/iron balance, with between 60 and 30 wt % of an iron powder and carbon powder, and optionally copper in the amount of 4 to 6 wt % if present, optionally up to 5 wt % of one or more metallic sulfides, and optionally up to 1 wt % sulphur as elemental sulphur or pre-alloyed in said pre-alloyed powder, the final composition being such that the total carbon content of the sintered material lies in the range from 0.8 to 1.5 wt %.

In preferred embodiments of the invention, the pressed and sintered powder mixture may include from 4 to 6 wt % of copper, and/or one or more metallic sulfides in an amount up to 5 wt %, and/or sulphur in an amount up to 1 wt %. Also, the residual porosity in the pressed and sintered matrix may be filled with a copper-based alloy. Still further, in a preferred embodiment the pressed powder body was sintered at a temperature of not greater than about 1100° C.

The invention will now be further illustrated with reference to the following examples.

EXAMPLE 1

49.75 wt % of a powder having a composition of within the ranges C 0.95–1.05/W 5.5–6.2/Mo 5.5–6.2/V 2.8–3.1/Cr 3.8–4.2/Others 2.5 max./Fe balance was mixed with 49.75 wt % of Hoganas NC-100.24 (trade mark) powder and with 0.5 wt % of graphite powder. To this was added 0.75 wt % of a lubricant wax to act as a pressing and die lubricant. The powders were mixed for 30 minutes in a Y-cone rotating mixer. Articles were then pressed using double-sided pressing at a pressure of 540 MPa. The pressed green body was then stacked with a pressed compact of a copper alloy weighing 24.5% of the weight of the green body. The articles were then simultaneously sintered and infiltrated under a hydrogen and nitrogen atmosphere at 1100° C. for 30 minutes. The resulting articles had a composition of C 0.81/W 2.47/Mo 2.60/V 1.28/Cr 1.75/Cu 21.50/Fe balance. These articles were then cryogenically treated for 20 minutes at −120° C. and finally tempered in air at 700° C. for 2 hours.

EXAMPLE 2

The same procedure was adopted as with Example 1 up to and including the stage of mixing in the Y-cone mixer. The mixed powders were then pressed using double-sided pressing at 770 MPa. The pressed green bodies were then stacked with pressed copper alloy compacts weighing 20% of the weight of the green body. Sintering and infiltration was then carried out as before with Example 1. The resulting articles had composition of C 0.82/W 2.23/Mo 2.26/V 1.20/Cr 1.60/Cu 16.80/Fe balance. These articles were then cryogenically treated as before but finally tempered in air at 600° C. for 2 hours.

Mechanical tests were then carried out on samples of Examples 1 and 2. The average results for the properties measured are given in Table 1 below.

TABLE 1

| | Example 1 | | | Example 2 | | |
|---|---|---|---|---|---|---|
| Property | 20° C. | 300° C. | 500° C. | 20° C. | 300° C. | 500° C. |
| Youngs Mod. (GPa) | 137 | 127 | 111 | 187 | 167 | 150 |
| Comp. Pr. Stress (0.2%) (MPa) | 809 | 669 | 519 | 1086 | 863 | 773 |
| Hardness (HR30N) | 49 | 45 | 35 | 66 | 62 | 58 |

Valve seat inserts made by the method used for Example 2 above were fitted in the exhaust positions of a 1600 cc, 4-cylinder engine. The engine was run continuously for 180 hours at 6250 r.p.m. at full load on unleaded gasoline.

At the completion of the test the wear on both the valve seat inserts and the valves was measured. The results are set out below in Table 2.

TABLE 2

| | Cylinder No. | | | |
|---|---|---|---|---|
| Wear (mm) | 1 | 2 | 3 | 4 |
| Valve seat insert (mm) | 0.013 | 0.028 | 0.028 | 0.033 |
| Valve (mm) | 0.013 | 0.005 | 0.033 | 0.008 |

The valves in the above engine test were plain alloyed steel with no hard facing of the valve seating area. The engine manufacturers specification for such a test is that valve seat insert wear should not exceed 0.3 mm. It is clear, therefore, that in the above test the wear in the worst case did not exceed about 10% of that allowable.

EXAMPLE 3

49.75 wt % of powder of similar specification to that used in Example 1, was mixed with 49.75 wt % of Hoganas ABC 100.30 (trade mark) powder and with 0.50 wt % of graphite powder. To this was added 0.50 wt % of a lubricant wax to act as a pressing and die lubricant. The powders were mixed for 30 minutes in a Y-cone rotating mixer. Articles were then pressed using double-sided pressing to a green density of at least 7.1 $Mg/m^3$. The pressed green body was then stacked with a pressed compact of a copper alloy weighing 20.0 wt % of the weight of the green body. The articles were then simultaneously sintered and infiltrated under a hydrogen and nitrogen atmosphere at 1100° C. for 30 minutes. The resulting articles were then cryogenically treated for 20 minutes at −120° C. and finally tempered in air at 600° C. for 2 hours.

Mechanical tests carried out on samples from Example 3 gave the results in Table 3 below.

TABLE 3

| Property | 20° C. | 300° C. | 500° C. |
|---|---|---|---|
| Young's Mod. (GPa) | 193 | 184 | 163 |
| Comp. Pr. Stress (0.2%) (MPa) | 1090 | 930 | 790 |
| Hardness (HR30N) | 65 | 60 | 52 |

Valve seat inserts made by the method used for Example 3 were fitted in the exhaust positions of a 2.0 liter, 4 cylinder engine. The engine was cycled 4 minutes at 6000 r.p.m, followed by 1 minute of idling, for 100 hours, and then run at 6000 r.p.m. for 25 continuous hours, on leaded gasolene.

At the completion of the test the wear on both the valve seat inserts and the valves was measured. The results are set out in Table 4.

TABLE 4

| | Cylinder Number | | | |
|---|---|---|---|---|
| | 1 | 2 | 3 | 4 |
| Valve seat Wear (mm) | 0.015 | 0.023 | 0.027 | 0.024 |
| Valve Wear (mm) | 0.018 | 0.020 | 0.041 | 0.010 |

The valves in the above engine test were stellite-faced and sodium filled. The engine manufacturer's specification for such a test is that the valves should not wear by more than 0.045 mm, and the valve seat inserts should not wear by more than 0.09 mm. The wear values are thus within the manufacturer's acceptance limits.

EXAMPLE 4

45.9 wt % of powder of similar specification to that used in Example 1 was mixed with 53.2 wt % of Atomet 28 (trade mark) iron powder and 0.9 wt % of graphite powder. To this was added 5 wt % of 300 mesh copper powder as a sintering aid, 1 wt % of manganese sulphide and 0.5 wt % of a lubricant wax. The powders were mixed in a Y-cone mixer and then pressed using double-sided pressing to a density of at least 7.0 $Mg/m^3$. The green bodies were then sintered under a hydrogen and nitrogen atmosphere at 1100° C. for 30 minutes. The sintered bodies were then cryogenically treated for 20 minutes at −120° C. and finally tempered at 600° C. for 2 hours.

Mechanical tests were carried out on samples of Example 4 at various temperatures and gave the average results shown in Table 5.

TABLE 5

| Property | 20° C. | 300° C. | 500° C. |
|---|---|---|---|
| Young's Mod. (GPa) | 138 | 128 | 111 |
| Comp. Pr. Stress (0.2%) (MPa) | 865 | 776 | 550 |
| Hardness (HR30N) | 55 | 49 | 35 |

We claim:

1. A valve seat insert for an internal combustion engine cylinder head consisting of a sintered ferrous-based material having a matrix comprising a pressed and sintered powder, the metallurgical structure of the matrix comprising tempered martensite containing spheroidal alloy carbides, bainite and ferrite, the powder having been pressed to greater than 80% of theoretical density from a mixture including two different ferrous-based powders, the mixture consisting essentially of between 40 and 70 wt % of a pre-alloyed powder having a composition in wt %, apart from impurities, within the ranges of: carbon 0.45–1.05/tungsten 2.7–6.2/molybdenum 2.8–6.2/vanadium 2.8–3.2/chromium 3.8–4.5/iron balance, with between 60 and 30 wt % of an iron powder and carbon powder, and optionally copper in the amount of 4 to 6 wt % if present, optionally up to 5 wt % of one or more metallic sulfides, and optionally up to 1 wt % sulphur as elemental sulphur or pre-alloyed in said pre-alloyed powder, the final composition being such that the total carbon content of the sintered material lies in the range from 0.8 to 1.5 wt %.

2. A valve seat insert according to claim 1 wherein the pressed and sintered powder mixture includes from 4 to 6 wt % of copper.

3. A valve seat insert according to claim 1 wherein the pressed and sintered powder mixture includes one or more metallic sulfides in an amount up to 5 wt %.

4. A valve seat insert according to claim 1 wherein the pressed and sintered powder mixture includes sulphur in an amount up to 1 wt %.

5. A valve seat insert according to claim 1 wherein residual porosity in the pressed and sintered matrix is filled with a copper-based alloy.

6. A valve seat insert as claimed in claim 1 wherein the pressed powder body was sintered at a temperature of not greater than about 1100° C.

* * * * *